US006189502B1

(12) United States Patent
Lai

(10) Patent No.: US 6,189,502 B1
(45) Date of Patent: Feb. 20, 2001

(54) GROOVED DOUBLE COMBUSTION CHAMBER ROTARY ENGINE

(76) Inventor: Jui H. Lai, No. 171, Sec. 2, Bin Hai Road, Au Ao, I-Lan Hsien (TW)

( * ) Notice: Under 35 U.S.C. 154(b), the term of this patent shall be extended for 0 days.

(21) Appl. No.: 09/280,075

(22) Filed: Mar. 29, 1999

(30) Foreign Application Priority Data

Mar. 2, 1999 (TW) ..... 88103129

(51) Int. Cl.[7] ..... F02B 53/84

(52) U.S. Cl. ..... 123/239; 123/236; 123/8.11; 418/148; 418/255; 418/258

(58) Field of Search ..... 123/239, 236, 123/8.11, 44 D; 418/148, 255, 258

(56) References Cited

U.S. PATENT DOCUMENTS

| | | | | |
|---|---|---|---|---|
| 680,478 | * | 8/1901 | English et al. | 418/258 |
| 686,089 | * | 11/1901 | Kochendarfer | 418/255 |
| 939,751 | * | 11/1909 | Schulz | 123/231 |
| 1,032,342 | * | 7/1912 | Morell | 418/255 |
| 1,249,881 | * | 12/1917 | Anglada | 418/255 |
| 1,964,492 | * | 6/1934 | Yandell | 418/148 |
| 3,215,129 | * | 11/1965 | Johnson | 123/236 |
| 3,266,470 | * | 8/1966 | Burke et al. | 123/236 |
| 3,848,575 | * | 11/1974 | Williams | 123/8.11 |
| 4,308,836 | * | 1/1982 | Wilkinson | 123/44 D |
| 5,224,850 | * | 7/1993 | Koh | 418/148 |
| 5,551,853 | * | 9/1996 | Cherry et al. | 418/148 |

FOREIGN PATENT DOCUMENTS

| | | | | |
|---|---|---|---|---|
| 403151522 | * | 6/1991 | (JP) | 123/239 |

* cited by examiner

*Primary Examiner*—Thomas Denion
*Assistant Examiner*—Thai-Ba Trieu
(74) *Attorney, Agent, or Firm*—Dougherty & Troxell

(57) ABSTRACT

A grooved double combustion chamber rotary engine includes a rotary compression unit, a rotary gas motor unit, and a combustion chamber, the rotary compression unit being connected to the respective rotary gas motor unit and the combustion chamber to constitute a stroke, and two strokes being alternating to achieve power output.

4 Claims, 7 Drawing Sheets

GROOVED DOUBLE COMBUSTION CHAMBER ROTARY ENGINE

BACKGROUND OF THE INVENTION (a) Field of the Invention

The present invention relates to an engine, more particularly to a rotary engine that has two combustion chambers, cylinders having curved correction grooves, and rotors provided with blade assemblies.

(b) Description of the Prior Art

Rotary gas devices of compressors, motors and engines, known in the art, have the function of replacing reciprocating piston engines. However, as the air-tightness and lubricating effects of rotary engines are comparatively poor, they are not as popular as reciprocating piston engines.

Reciprocating piston engines have certain drawbacks. One of them is that combustion occurs in constant volume, which causes generation of extremely high temperature and pressure, resulting in discharge of carbon monoxide that seriously pollutes the air. It is therefore worthwhile to make efforts to improve upon existing rotary engines so that they can be widely used.

Previously, the inventor had invented a combustion rotary engine and obtained the U.S. Pat. No. 5,596,963.

SUMMARY OF THE INVENTION

A primary object of the present invention is to provide a grooved double combustion chamber rotary engine that achieves a relative uniform mixing of fuel and air to allow complete combustion and that has enhanced compression effects.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
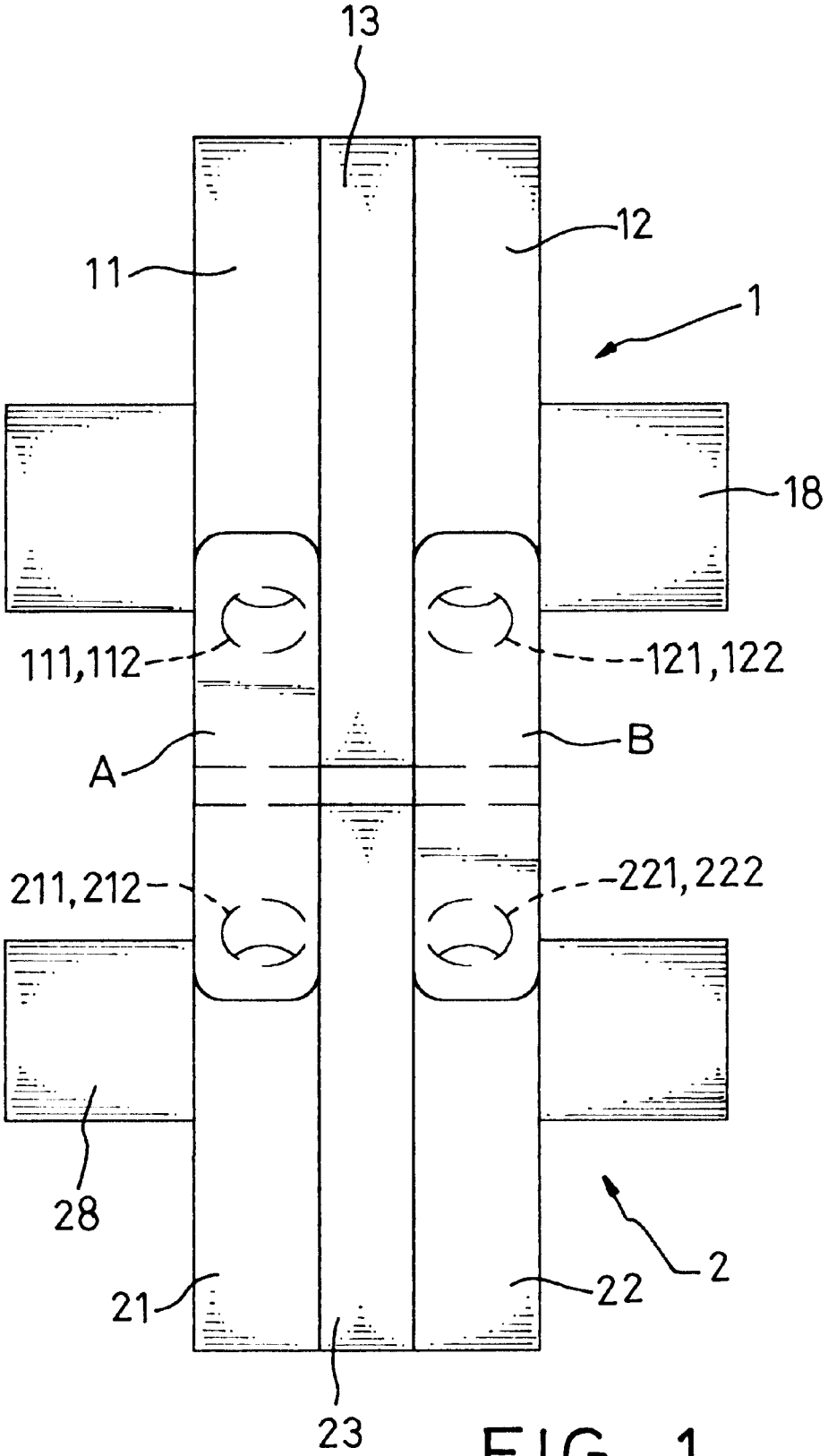
FIG. 1 is a schematic view of the arrangement of the present invention.
Figure 7:
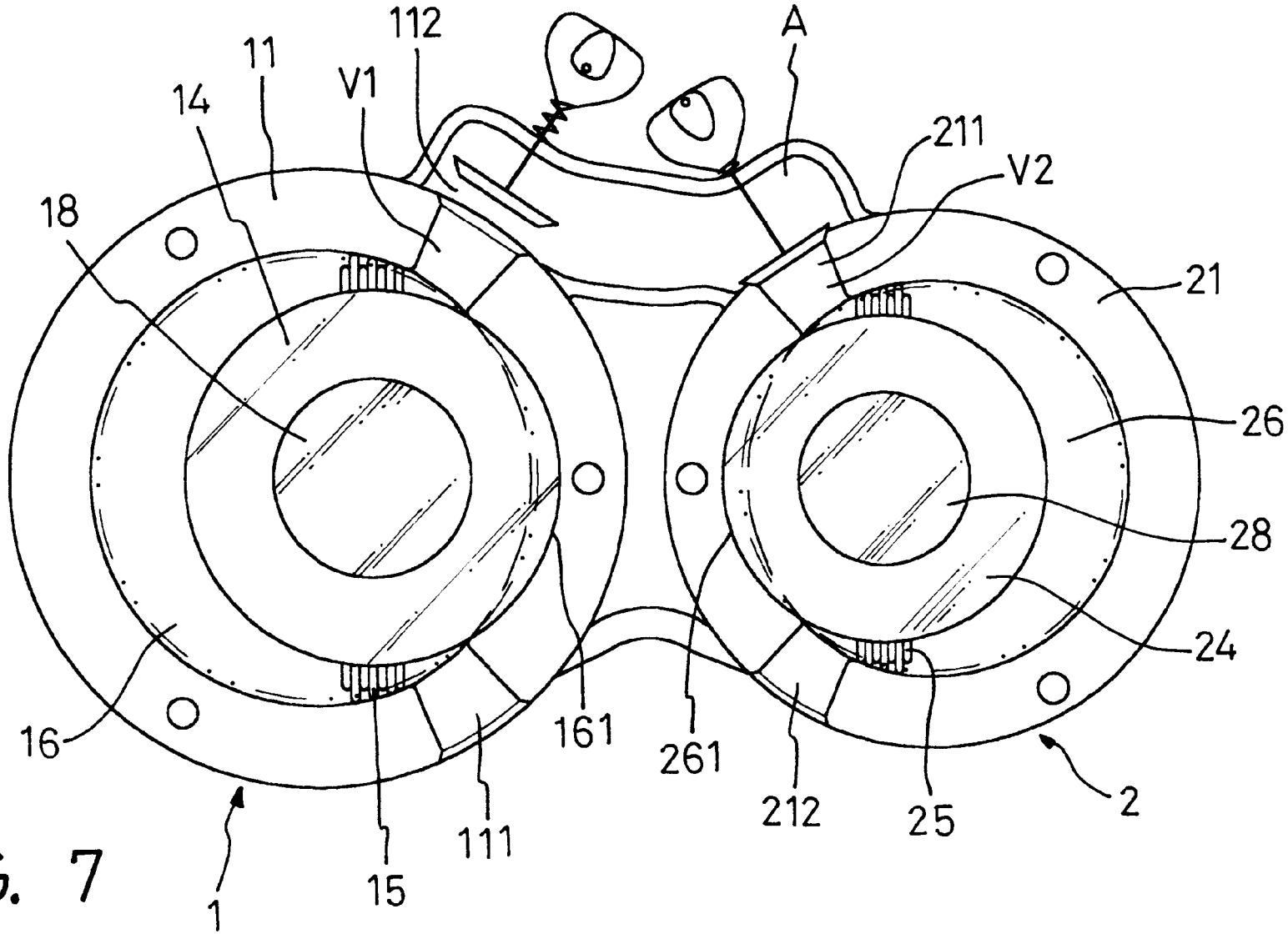
FIG. 7 is a schematic view illustrating operation of a first unit of the engine.
Figure 8:
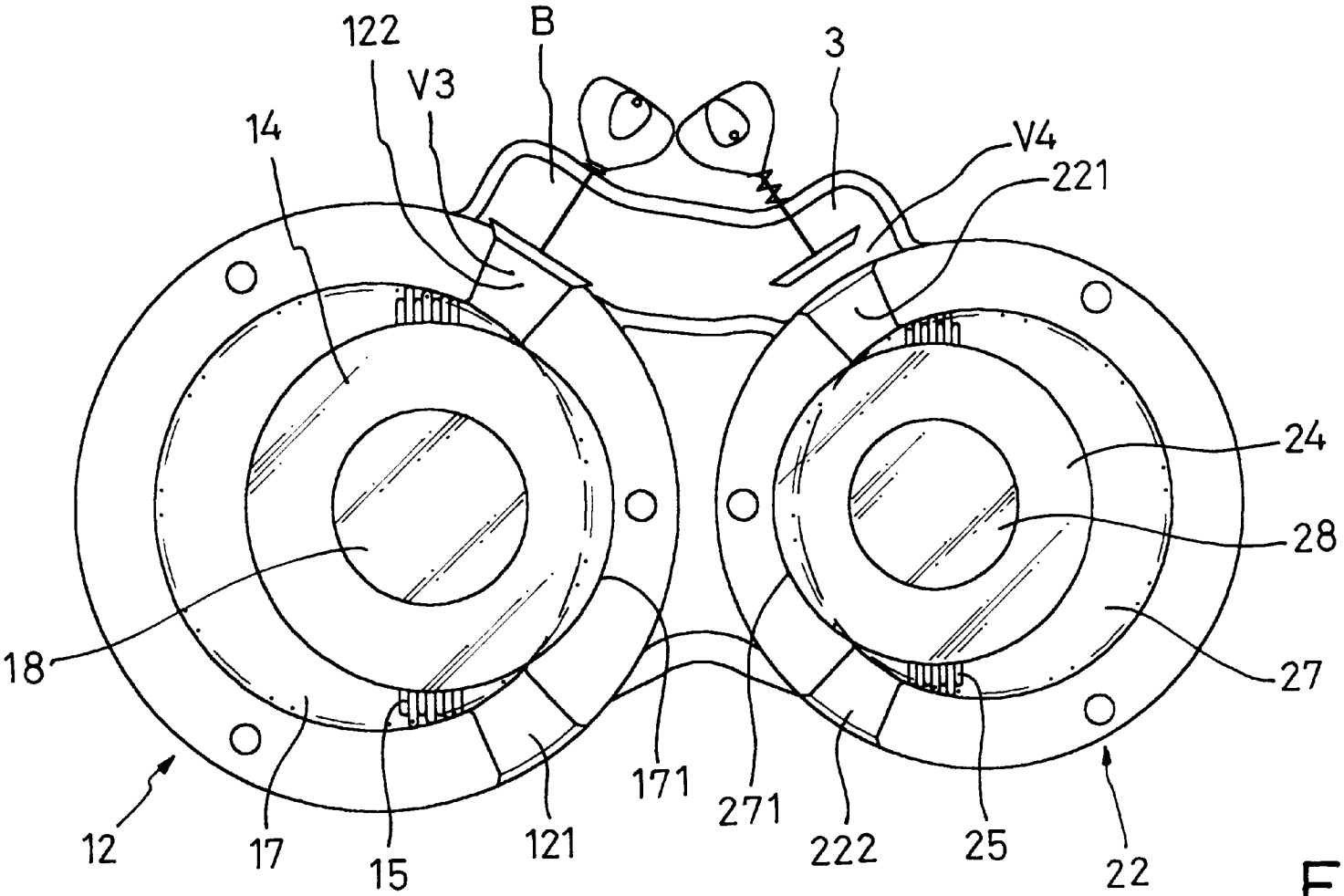
FIG. 8 is a schematic view illustrating operation of a second unit of the engine.

With reference to FIGS. 1, 7 and 8, the present invention essentially comprises a rotary compression unit 1, a rotary gas motor unit 2 interconnected with the rotary combustion unit 1, and a compression chamber 3 disposed therebetween. As the present invention is a double chamber construction, there are two units that are not inter-communicated each other. Besides, operation thereof is alternating.

Figure 2:
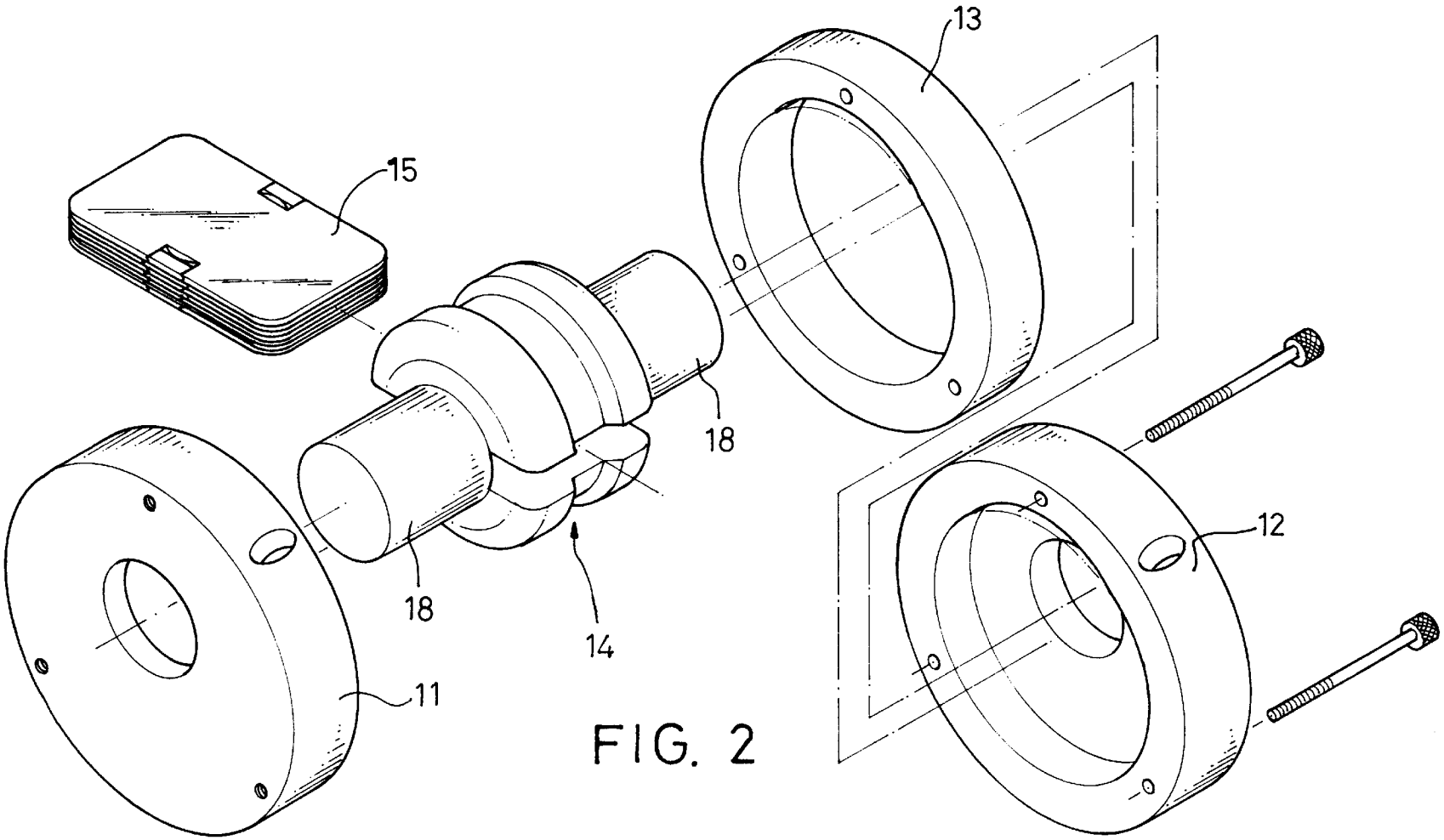
FIG. 2 is an exploded perspective view of a single unit of rotary engine of the present invention.
Figure 3:
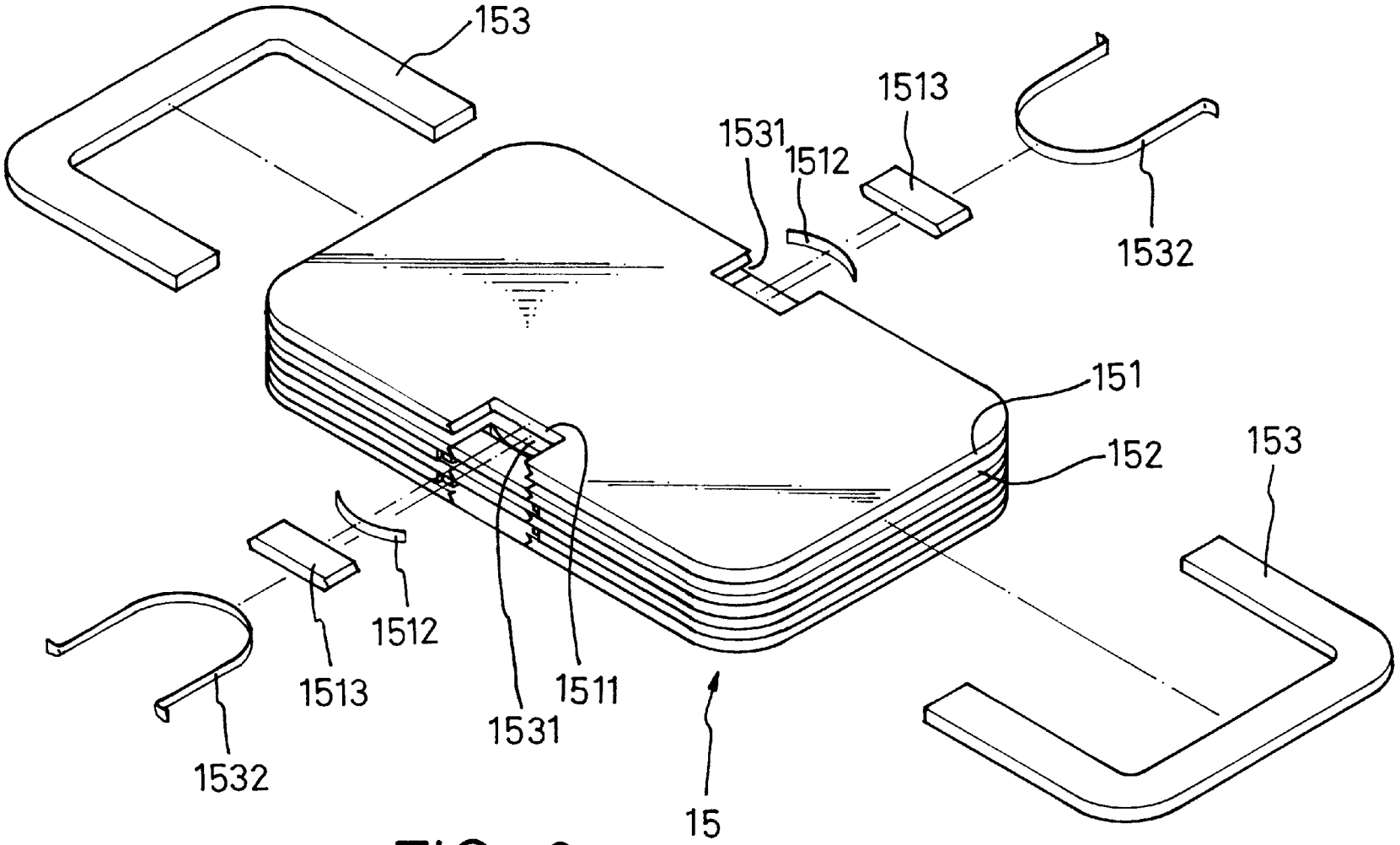
FIG. 3 is a perspective exploded view of a blade assembly of the present invention.

As shown in FIG. 2, the rotary compression unit 1 includes a front cylinder ring 11, a rear cylinder ring 12, an intermediate ring 13 lockably secured between the front and rear cylinder rings 11, 12 by screw rods, a rotor 14 insertably disposed therein, a blade assembly 15 insertably disposed in the center of the rotor 14. Due to the arrangement of the rotor 14, the rotary compression unit 1 is divided into a front compression chamber 16 (see FIG. 7) and a rear compression chamber 17 (see FIG. 8). The rotor 14 extends along its axis to form opposite output shafts 18.

Referring to FIGS. 3, 4, 5 and 6, the blade assembly 15 includes a plurality of spaced-apart fixed blades 151with a plurality of gaps 152 defined between adjacent blades 151. Each of the gaps 152 receives two U-shaped movable blades 153 inserted therein from opposite ends thereof. Therefore, when the rotor 14 rotates, the movable blades 153 will displace outwardly due to centrifugal force to abut tightly against inner walls of the front and rear cylinder rings 11, 12.

Figure 4:
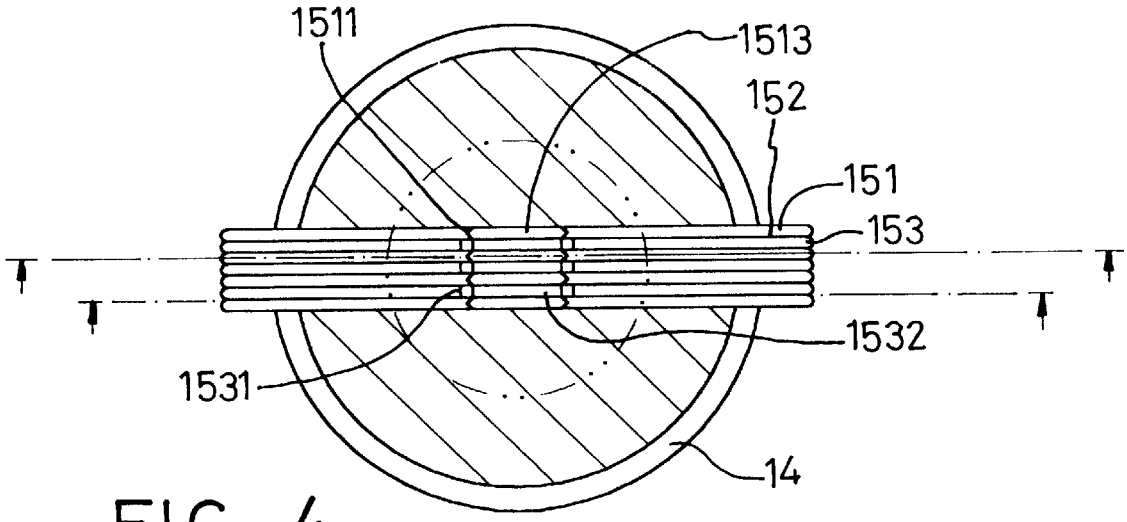
FIG. 4 is an assembled sectional view of the blade assembly and a rotor of the present invention.
Figure 5:
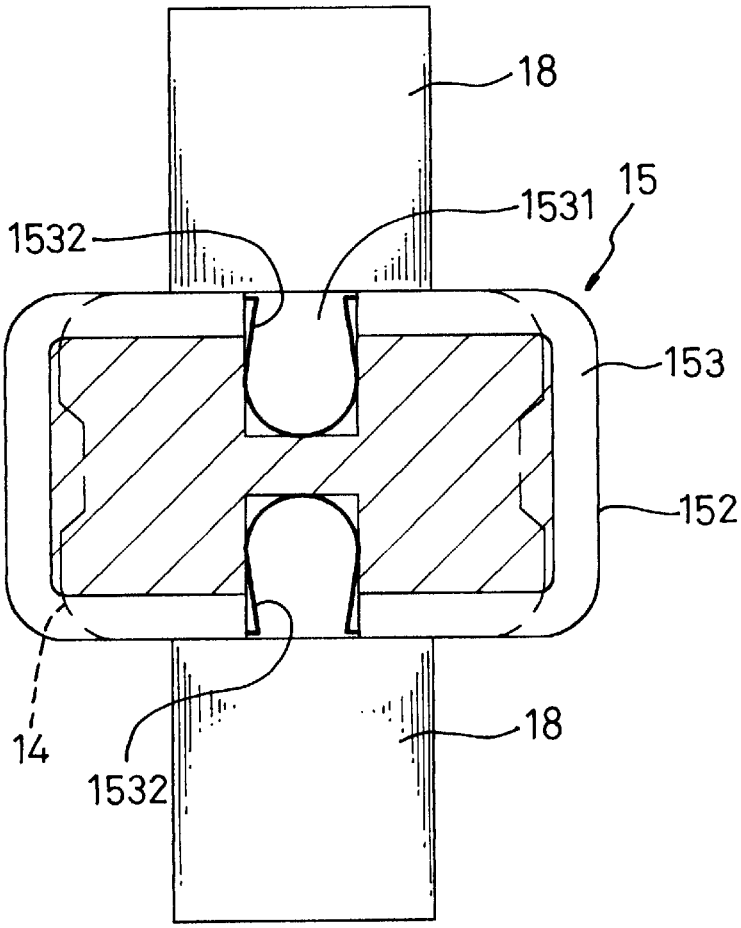
FIG. 5 is an assembled sectional view of fixed blades and the rotor of the present invention.
Figure 6:
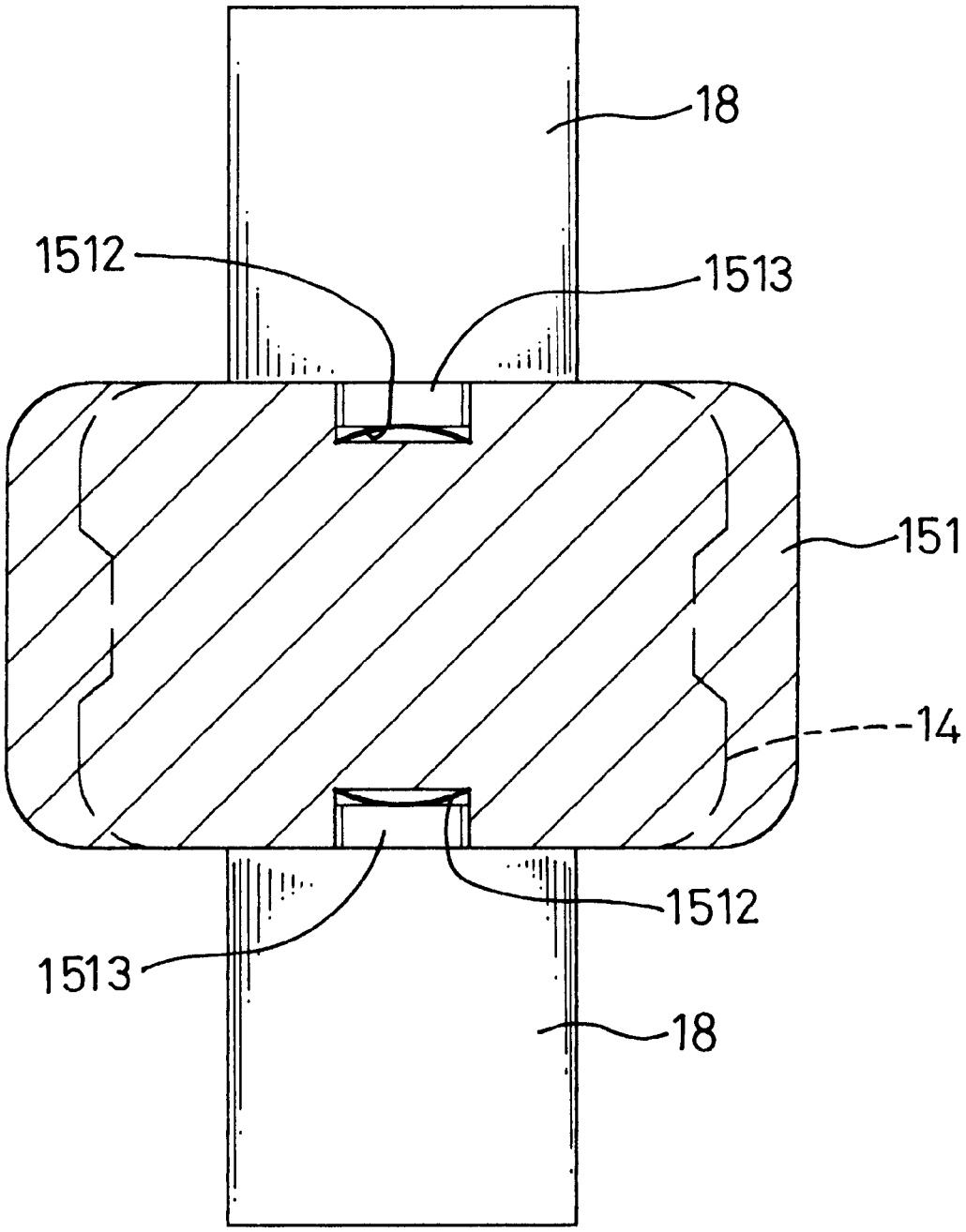
FIG. 6 is an assembled sectional view of movable blades and the rotor of the present invention.

With reference to FIG. 4, in order that the blade assembly 15 can constantly be positioned with respect to the rotor 14, indentations 1511 are formed on opposite sides of the fixed blades 151 in the middle, respectively, for insertion of a reed 1512 and an abutting block 1513. Each two movable blades 153 define a notch 1531 in a position corresponding to that of the indentations 1511 for receiving a spring 1532 to provide a resilient force during retraction of the movable blades 153. With reference to FIGS. 6 and 7, which illustrate the inter-relationship among the front and rear compression chambers 16, 17, the rotor 14, and the blade assembly 15, if the rotor 14 rotates using the output shafts 18 as an axis, due to the centrifugal force of the blade assembly 15, the true center of the front compression chamber 16 relative to the output shafts 18 is eccentric. Therefore, the shape of the front compression chamber 16 relative to the true circumference (as shown by imaginary lines) is slightly enlarged, and it has curved outward enlargements at the outermost portion of the blade assembly 15, forming curved grooves 161, 171 to avert interference. The same is with the rear compression chamber 17 shown in FIG. 8. Therefore, when the rotor 14 rotates, the blade assembly 15 can tightly abut against the inner walls of the front and rear compression chambers 16, 17 to enhance pressure.

In order to achieve intake and exhaust effects, the front and rear cylinder rings 11, 12 are respectively formed with a front intake port 111 and a rear intake port 121, and a front exhaust valve 112 and a rear exhaust valve 122. The front and rear exhaust valves 112, 122 are respectively communicated with the combustion chamber 3. Therefore, air can enter from the front and rear intake ports 111, 121 and, due to the pressing of the blade assembly 15, pass through the exhaust valves 112, 122 into the combustion chamber 3.

The rotary gas motor unit 2 is basically identical with the rotary compression unit 1 in terms of structure, only that it is smaller in size. Like the rotary compression unit 1, the rotary gas motor unit 2 includes front and rear cylinder rings 21, 22, an intermediate ring 23, a rotor 24, a blade assembly 25, front and rear combustion chambers 26, 27, and output shafts 28. Besides, the components, such as the fixed and movable blades 251, 253, are the same. Furthermore, inner walls of the combustion chambers 26, 27 also have curved outer enlargements 261, 271 due to the outward extension of the blade assembly 25 so as to prevent interference and maintain air-tightness. The reference numerals for the components of the rotary gas motor unit 2 correspond to those of the rotary compression unit 1 except that they all start with the number "2". The only differences are that the rotary gas motor unit 2 has front and rear intake valves 211, 221 and front and rear exhaust ports 212, 222, and that the output shafts are connected by a belt or chain to allow synchronous movement.

The combustion chamber 3 includes a front chamber and a rear chamber, namely, chamber A and chamber B in FIG. 1. Operation of the front and rear chambers is alternating. The combustion chamber 3 has cams to control front and rear intake ports 212, 222, and exhaust valves 112, 122. Besides, it is provided with an injector and an ignition device so that a mixture of fuel and air can, after compression, allow injection/explosion.

Referring back to FIG. 1, FIGS. 7 and 8 during operation, since there are two chambers, the front chamber, i.e., the chamber A, has the front exhaust valve 112 (designated by V1), the front intake valve 211 (designated by V2), the rear exhaust valve 122 (designated by V3), and the rear intake valve 221 (designated by V2) as control valves. And due to alternating operation, when V1 opens, V2 closes. At this point, compression occurs in chamber A. At the same time, V3 is closed while V4 is open, and explosion occurs in chamber B. Therefore, there is output of power (see FIG. 7). Subsequently, V1 closes; V2 opens. Explosion occurs in chamber A and there is power output. At the same time, V3 opens while V4 closes. At this point, compression occurs in chamber B (see FIG. 8). Therefore, there are two greater-than-180° strokes within 360°. In other words, the engine having two-chamber construction of the present invention is comparable to a conventional four-cylinder engine in terms of power output.

In the present invention, due to the alternating action of the double chamber compression chamber, there can be a relative uniform mixing of fuel and air to achieve complete combustion. Furthermore, because of the arrangement of the grooves, the blade assembly can rotate while abutting tightly against the inner walls of the front and rear compression chambers of the rotary compression unit to enhance compression effects. It can be appreciated that these improvements are not found in conventional rotary engines.

Although the present invention has been illustrated and described with reference to the preferred embodiment thereof, it should be understood that it is in no way limited to the details of such embodiment but is capable of numerous modifications within the scope of the appended claims.

What is claimed is:

1. A double chamber, rotary engine comprising:

a) at least one rotary compression unit having: a first cylinder ring assembly bounding a generally circular compression chamber with a curved groove extending outwardly from the generally circular compression chamber in communication with the compression chamber; a first intake port; and a valve controlled first exhaust port;

b) a first rotor having a circular cross-sectional configuration rotatably located within the first cylinder ring assembly so as to rotate about a first axis eccentrically located with respect to the generally circular compression chamber such that a portion of a periphery of the first rotor extends into the curved groove, the first rotor having a first blade assembly bearing against the first cylinder ring assembly;

c) at least one rotary motor unit separate from the at least one rotary compression unit and having: a second cylinder ring assembly bounding a generally circular expansion chamber with a curved enlargement extending outwardly therefrom in communication with the expansion chamber; a valve controlled second intake port; and a second exhaust port;

d) a second rotor having a circular cross-sectional configuration rotatably located within the second cylinder ring assembly about a second axis eccentrically located with respect to the generally circular expansion chamber such that a portion of a periphery of the second rotor extends into the curved enlargement, the second rotor having a second blade assembly bearing against the second circular ring assembly; and e) a combustion chamber assembly communicating with the valve controlled first exhaust port and the valve controlled second intake port.

2. The double chamber rotary engine as claimed in claim 1 further comprising:

a) a first shaft affixed to the first rotor so as to rotate therewith; and, b) a second shaft affixed to the second rotor so as to rotate therewith, wherein the first and second shafts are connected together.

3. The double chamber rotary engine as claimed in claim 1, wherein said first and second blade assemblies each include a plurality of spaced-apart fixed blades, with gaps defined between adjacent fixed blades, and a plurality of U-shaped movable blades movably disposed in each of said gaps, a center of each of said first and second rotors having grooves in which are inserted said blade assemblies, whereby when said rotors rotate, said movable blades are displaced outwardly due to centrifugal force.

4. The double chamber rotary engine as claimed in claim 1, wherein said fixed blades each have an indentation formed on opposite sides in the middle thereof; reeds and abutting blocks located in the indentation abutting against said rotor; and said movable blades being provided with a spring in a position corresponding to said indentation to provide an outward biasing force thereon.

* * * * *